US008750458B1

(12) United States Patent
Wang et al.

(10) Patent No.: US 8,750,458 B1
(45) Date of Patent: Jun. 10, 2014

(54) COLD ELECTRON NUMBER AMPLIFIER

(75) Inventors: Dongbing Wang, Lathrop, CA (US); Dave Reynolds, Orem, UT (US)

(73) Assignee: Moxtek, Inc., Orem, UT (US)

( * ) Notice: Subject to any disclaimer, the term of this patent is extended or adjusted under 35 U.S.C. 154(b) by 373 days.

(21) Appl. No.: 13/307,559

(22) Filed: Nov. 30, 2011

Related U.S. Application Data

(60) Provisional application No. 61/443,822, filed on Feb. 17, 2011.

(51) Int. Cl.
*H01J 35/00* (2006.01)

(52) U.S. Cl.
USPC ..... 378/122

(58) Field of Classification Search
CPC ..... H01J 35/06; H01J 35/065; H01J 35/16; H01J 2235/068
USPC ..... 378/119, 121, 122, 134, 136
See application file for complete search history.

(56) References Cited

U.S. PATENT DOCUMENTS

| | | | |
|---|---|---|---|
| 1,276,706 | A | 8/1918 | Aydelotte |
| 1,881,448 | A | 10/1932 | Forde et al. |
| 1,946,288 | A | 2/1934 | Kearsley |
| 2,291,948 | A | 8/1942 | Cassen |
| 2,316,214 | A | 4/1943 | Atlee et al. |
| 2,329,318 | A | 9/1943 | Atlee et al. |
| 2,340,363 | A | 2/1944 | Atlee et al. |
| 2,502,070 | A | 3/1950 | Atlee et al. |
| 2,663,812 | A | 3/1950 | Jamison et al. |
| 2,683,223 | A | 7/1954 | Hosemann |
| 2,952,790 | A | 9/1960 | Steen |
| 3,356,559 | A | 12/1967 | Juras |
| 3,358,368 | A | 12/1967 | Kuhnl |
| 3,397,337 | A | 8/1968 | Denholm |

(Continued)

FOREIGN PATENT DOCUMENTS

| | | |
|---|---|---|
| DE | 1030936 | 5/1958 |
| DE | 4430623 | 3/1996 |

(Continued)

OTHER PUBLICATIONS

Chakrapani et al.; Capillarity-Driven Assembly of Two-Dimensional Cellular Carbon Nanotube Foams; PNAS; Mar. 23, 2004; pp. 4009-4012; vol. 101; No. 12.

(Continued)

*Primary Examiner* — Jurie Yun
(74) *Attorney, Agent, or Firm* — Thorpe North & Western LLP

(57) ABSTRACT

A cold electron number amplifier device can provide a greater number of electrons at lower electron emitter temperature. The cold electron number amplifier device can comprise an evacuated enclosure 11, a first electron emitter 12 attached to the evacuated enclosure 11, and an electrically conductive second electron emitter 13 also attached to the evacuated enclosure. The first electron emitter 12 can be configured to emit electrons 14 within the evacuated enclosure 11. The second electron emitter 13 can have a voltage V2 greater than a voltage V1 of the first electron emitter 12 (V2>V1). The second electron emitter 13 can be positioned to receive impinging electrons 14 from the first electron emitter 12. Electrons 14 from the first electron emitter 12 can impart energy to electrons in the second electron emitter 13 and cause the second electron emitter 13 to emit more electrons 15.

4 Claims, 3 Drawing Sheets

(56) References Cited

U.S. PATENT DOCUMENTS

| | | | |
|---|---|---|---|
| 3,434,062 | A | 3/1969 | Cox |
| 3,665,236 | A | 5/1972 | Gaines et al. |
| 3,679,927 | A | 7/1972 | Kirkendall |
| 3,691,417 | A | 9/1972 | Gralenski |
| 3,741,797 | A | 6/1973 | Chavasse, Jr. et al. |
| 3,751,701 | A | 8/1973 | Gralenski et al. |
| 3,801,847 | A | 4/1974 | Dietz |
| 3,828,190 | A | 8/1974 | Dahlin et al. |
| 3,851,266 | A | 11/1974 | Conway |
| 3,872,287 | A | 3/1975 | Koeman |
| 3,882,339 | A | 5/1975 | Rate et al. |
| 3,894,219 | A | 7/1975 | Weigel |
| 3,962,583 | A | 6/1976 | Holland et al. |
| 3,970,884 | A | 7/1976 | Golden |
| 4,007,375 | A | 2/1977 | Albert |
| 4,075,526 | A | 2/1978 | Grubis |
| 4,160,311 | A | 7/1979 | Ronde et al. |
| 4,163,900 | A | 8/1979 | Warren et al. |
| 4,178,509 | A | 12/1979 | More et al. |
| 4,184,097 | A | 1/1980 | Auge |
| 4,250,127 | A | 2/1981 | Warren et al. |
| 4,293,373 | A | 10/1981 | Greenwood |
| 4,368,538 | A | 1/1983 | McCorkle |
| 4,393,127 | A | 7/1983 | Greschner et al. |
| 4,400,822 | A | 8/1983 | Kuhnke et al. |
| 4,421,986 | A | 12/1983 | Friauf et al. |
| 4,443,293 | A | 4/1984 | Mallon et al. |
| 4,463,338 | A | 7/1984 | Utner et al. |
| 4,521,902 | A | 6/1985 | Peugeot |
| 4,532,150 | A | 7/1985 | Endo et al. |
| 4,573,186 | A | 2/1986 | Reinhold |
| 4,576,679 | A | 3/1986 | White |
| 4,584,056 | A | 4/1986 | Perret et al. |
| 4,591,756 | A | 5/1986 | Avnery |
| 4,608,326 | A | 8/1986 | Neukermans et al. |
| 4,645,977 | A | 2/1987 | Kurokawa et al. |
| 4,675,525 | A | 6/1987 | Amingual et al. |
| 4,679,219 | A | 7/1987 | Ozaki |
| 4,688,241 | A | 8/1987 | Peugeot |
| 4,696,994 | A | 9/1987 | Nakajima et al. |
| 4,705,540 | A | 11/1987 | Hayes |
| 4,734,924 | A | 3/1988 | Yahata et al. |
| 4,761,804 | A | 8/1988 | Yahata |
| 4,777,642 | A | 10/1988 | Ono |
| 4,797,907 | A | 1/1989 | Anderton |
| 4,818,806 | A | 4/1989 | Kunimune et al. |
| 4,819,260 | A | 4/1989 | Haberrecker |
| 4,862,490 | A | 8/1989 | Karnezos et al. |
| 4,870,671 | A | 9/1989 | Hershyn |
| 4,876,330 | A | 10/1989 | Higashi et al. |
| 4,878,866 | A | 11/1989 | Mori et al. |
| 4,885,055 | A | 12/1989 | Woodbury et al. |
| 4,891,831 | A | 1/1990 | Tanaka et al. |
| 4,933,557 | A | 6/1990 | Perkins et al. |
| 4,939,763 | A | 7/1990 | Pinneo et al. |
| 4,957,773 | A | 9/1990 | Spencer et al. |
| 4,960,486 | A | 10/1990 | Perkins et al. |
| 4,969,173 | A | 11/1990 | Valkonet |
| 4,979,198 | A | 12/1990 | Malcolm et al. |
| 4,979,199 | A | 12/1990 | Cueman et al. |
| 4,995,069 | A | 2/1991 | Tanaka |
| 5,010,562 | A | 4/1991 | Hernandez et al. |
| 5,063,324 | A | 11/1991 | Grunwald |
| 5,066,300 | A | 11/1991 | Isaacson et al. |
| 5,077,771 | A | 12/1991 | Skillicorn et al. |
| 5,077,777 | A | 12/1991 | Daly |
| 5,090,046 | A | 2/1992 | Friel |
| 5,105,456 | A | 4/1992 | Rand et al. |
| 5,117,829 | A | 6/1992 | Miller et al. |
| 5,153,900 | A | 10/1992 | Nomikos et al. |
| 5,161,179 | A | 11/1992 | Suzuki et al. |
| 5,173,612 | A | 12/1992 | Imai et al. |
| 5,178,140 | A | 1/1993 | Ibrahim |
| 5,187,737 | A | 2/1993 | Watanabe |
| 5,196,283 | A | 3/1993 | Ikeda et al. |
| 5,200,984 | A | 4/1993 | Laeuffer |
| 5,217,817 | A | 6/1993 | Verspui et al. |
| 5,226,067 | A | 7/1993 | Allred et al. |
| RE34,421 | E | 10/1993 | Parker et al. |
| 5,258,091 | A | 11/1993 | Imai et al. |
| 5,267,294 | A | 11/1993 | Kuroda et al. |
| 5,302,523 | A | 4/1994 | Coffee et al. |
| 5,343,112 | A | 8/1994 | Wegmann et al. |
| 5,347,571 | A | 9/1994 | Furbee et al. |
| 5,391,958 | A | 2/1995 | Kelly |
| 5,400,385 | A | 3/1995 | Blake et al. |
| 5,422,926 | A | 6/1995 | Smith et al. |
| 5,428,658 | A | 6/1995 | Oettinger et al. |
| 5,432,003 | A | 7/1995 | Plano et al. |
| 5,469,429 | A | 11/1995 | Yamazaki et al. |
| 5,469,490 | A | 11/1995 | Golden et al. |
| 5,478,266 | A | 12/1995 | Kelly |
| 5,521,851 | A | 5/1996 | Wei et al. |
| 5,524,133 | A | 6/1996 | Neale et al. |
| 5,532,003 | A | 7/1996 | Wong et al. |
| RE35,383 | E | 11/1996 | Miller et al. |
| 5,571,616 | A | 11/1996 | Phillips et al. |
| 5,578,360 | A | 11/1996 | Viitanen |
| 5,592,042 | A | 1/1997 | Takuchi et al. |
| 5,602,507 | A | 2/1997 | Suzuki |
| 5,607,723 | A | 3/1997 | Plano et al. |
| 5,621,780 | A | 4/1997 | Smith et al. |
| 5,627,871 | A | 5/1997 | Wang |
| 5,631,943 | A | 5/1997 | Miles |
| 5,673,044 | A | 9/1997 | Pellon |
| 5,680,433 | A | 10/1997 | Jensen |
| 5,682,412 | A | 10/1997 | Skillicorn et al. |
| 5,696,808 | A | 12/1997 | Lenz |
| 5,706,354 | A | 1/1998 | Stroehlein |
| 5,729,583 | A | 3/1998 | Tang et al. |
| 5,774,522 | A | 6/1998 | Warburton |
| 5,812,632 | A | 9/1998 | Schardt et al. |
| 5,835,561 | A | 11/1998 | Moorman et al. |
| 5,870,051 | A | 2/1999 | Warburton et al. |
| 5,898,754 | A | 4/1999 | Gorzen |
| 5,907,595 | A | 5/1999 | Sommerer |
| 5,978,446 | A | 11/1999 | Resnick |
| 6,002,202 | A | 12/1999 | Meyer et al. |
| 6,005,918 | A | 12/1999 | Harris et al. |
| 6,044,130 | A | 3/2000 | Inazura et al. |
| 6,062,931 | A | 5/2000 | Chung et al. |
| 6,063,629 | A | 5/2000 | Knoblauch |
| 6,069,278 | A | 5/2000 | Chuang |
| 6,073,484 | A | 6/2000 | Miller et al. |
| 6,075,839 | A | 6/2000 | Treseder |
| 6,097,790 | A | 8/2000 | Hasegawa et al. |
| 6,129,901 | A | 10/2000 | Moskovits et al. |
| 6,133,401 | A | 10/2000 | Jensen |
| 6,134,300 | A | 10/2000 | Trebes et al. |
| 6,184,333 | B1 | 2/2001 | Gray |
| 6,205,200 | B1 | 3/2001 | Boyer et al. |
| 6,277,318 | B1 | 8/2001 | Bower et al. |
| 6,282,263 | B1 | 8/2001 | Arndt et al. |
| 6,288,209 | B1 | 9/2001 | Jensen |
| 6,307,008 | B1 | 10/2001 | Lee et al. |
| 6,320,019 | B1 | 11/2001 | Lee et al. |
| 6,351,520 | B1 | 2/2002 | Inazaru |
| 6,385,294 | B2 | 5/2002 | Suzuki et al. |
| 6,388,359 | B1 | 5/2002 | Duelli et al. |
| 6,438,207 | B1 | 8/2002 | Chidester et al. |
| 6,477,235 | B2 | 11/2002 | Chornenky et al. |
| 6,487,272 | B1 | 11/2002 | Kutsuzawa |
| 6,487,273 | B1 | 11/2002 | Takenaka et al. |
| 6,494,618 | B1 | 12/2002 | Moulton |
| 6,546,077 | B2 | 4/2003 | Chornenky et al. |
| 6,567,500 | B2 | 5/2003 | Rother |
| 6,645,757 | B1 | 11/2003 | Okandan et al. |
| 6,646,366 | B2 | 11/2003 | Hell et al. |
| 6,658,085 | B2 | 12/2003 | Sklebitz |
| 6,661,876 | B2 | 12/2003 | Turner et al. |
| 6,740,874 | B2 | 5/2004 | Doring |
| 6,778,633 | B1 | 8/2004 | Loxley et al. |
| 6,799,075 | B1 | 9/2004 | Chornenky et al. |
| 6,803,570 | B1 | 10/2004 | Bryson, III et al. |

(56) References Cited

U.S. PATENT DOCUMENTS

| | | | |
|---|---|---|---|
| 6,803,571 | B1 | 10/2004 | Mankos et al. |
| 6,816,573 | B2 | 11/2004 | Hirano et al. |
| 6,819,741 | B2 | 11/2004 | Chidester |
| 6,838,297 | B2 | 1/2005 | Iwasaki et al. |
| 6,852,365 | B2 | 2/2005 | Smart et al. |
| 6,866,801 | B1 | 3/2005 | Mau et al. |
| 6,876,724 | B2 | 4/2005 | Zhou et al. |
| 6,900,580 | B2 | 5/2005 | Dai et al. |
| 6,956,706 | B2 | 10/2005 | Brandon |
| 6,962,782 | B1 | 11/2005 | Livache et al. |
| 6,976,953 | B1 | 12/2005 | Pelc |
| 6,987,835 | B2 | 1/2006 | Lovoi |
| 7,035,379 | B2 | 4/2006 | Turner et al. |
| 7,046,767 | B2 | 5/2006 | Okada et al. |
| 7,049,735 | B2 | 5/2006 | Ohkubo et al. |
| 7,050,539 | B2 | 5/2006 | Loef et al. |
| 7,075,699 | B2 | 7/2006 | Oldham et al. |
| 7,085,354 | B2 | 8/2006 | Kanagami |
| 7,108,841 | B2 | 9/2006 | Smalley et al. |
| 7,110,498 | B2 | 9/2006 | Yamada |
| 7,130,380 | B2 | 10/2006 | Lovoi et al. |
| 7,130,381 | B2 | 10/2006 | Lovoi et al. |
| 7,189,430 | B2 | 3/2007 | Ajayan et al. |
| 7,203,283 | B1 | 4/2007 | Puusaari |
| 7,206,381 | B2 | 4/2007 | Shimono et al. |
| 7,215,741 | B2 | 5/2007 | Ukita |
| 7,224,769 | B2 | 5/2007 | Turner |
| 7,233,071 | B2 | 6/2007 | Furukawa et al. |
| 7,233,647 | B2 | 6/2007 | Turner et al. |
| 7,286,642 | B2 | 10/2007 | Ishikawa et al. |
| 7,305,066 | B2 | 12/2007 | Ukita |
| 7,317,784 | B2 | 1/2008 | Durst et al. |
| 7,358,593 | B2 | 4/2008 | Smith et al. |
| 7,382,862 | B2 | 6/2008 | Bard et al. |
| 7,399,794 | B2 | 7/2008 | Harmon et al. |
| 7,410,601 | B2 | 8/2008 | Sato et al. |
| 7,428,298 | B2 | 9/2008 | Bard et al. |
| 7,448,801 | B2 | 11/2008 | Oettinger et al. |
| 7,448,802 | B2 | 11/2008 | Oettinger et al. |
| 7,486,774 | B2 | 2/2009 | Cain |
| 7,526,068 | B2 | 4/2009 | Dinsmore |
| 7,529,345 | B2 | 5/2009 | Bard et al. |
| 7,618,906 | B2 | 11/2009 | Meilahti |
| 7,634,052 | B2 | 12/2009 | Grodzins et al. |
| 7,649,980 | B2 | 1/2010 | Aoki et al. |
| 7,650,050 | B2 | 1/2010 | Haffner et al. |
| 7,657,002 | B2 | 2/2010 | Burke et al. |
| 7,675,444 | B1 | 3/2010 | Smith et al. |
| 7,680,652 | B2 | 3/2010 | Giesbrecht et al. |
| 7,693,265 | B2 | 4/2010 | Hauttmann et al. |
| 7,709,820 | B2 | 5/2010 | Decker et al. |
| 7,737,424 | B2 | 6/2010 | Xu et al. |
| 7,756,251 | B2 | 7/2010 | Davis et al. |
| 7,915,800 | B2 * | 3/2011 | Kim et al. ..... 313/497 |
| 2002/0075999 | A1 | 6/2002 | Rother |
| 2002/0094064 | A1 | 7/2002 | Zhou et al. |
| 2003/0096104 | A1 | 5/2003 | Tobita et al. |
| 2003/0152700 | A1 | 8/2003 | Asmussen et al. |
| 2003/0165418 | A1 | 9/2003 | Ajayan et al. |
| 2004/0076260 | A1 | 4/2004 | Charles Jr et al. |
| 2005/0018817 | A1 | 1/2005 | Oettinger et al. |
| 2005/0141669 | A1 | 6/2005 | Shimono et al. |
| 2005/0207537 | A1 | 9/2005 | Ukita |
| 2006/0073682 | A1 | 4/2006 | Furukawa et al. |
| 2006/0098778 | A1 | 5/2006 | Oettinger et al. |
| 2006/0210020 | A1 | 9/2006 | Takahashi et al. |
| 2006/0233307 | A1 | 10/2006 | Dinsmore |
| 2006/0269048 | A1 | 11/2006 | Cain |
| 2006/0280289 | A1 | 12/2006 | Hanington et al. |
| 2007/0025516 | A1 | 2/2007 | Bard et al. |
| 2007/0087436 | A1 | 4/2007 | Miyawaki et al. |
| 2007/0111617 | A1 | 5/2007 | Meilahti |
| 2007/0133921 | A1 | 6/2007 | Haffner et al. |
| 2007/0142781 | A1 | 6/2007 | Sayre |
| 2007/0165780 | A1 | 7/2007 | Durst et al. |
| 2007/0176319 | A1 | 8/2007 | Thostenson et al. |
| 2007/0183576 | A1 | 8/2007 | Burke et al. |
| 2007/0217574 | A1 | 9/2007 | Beyerlein |
| 2008/0199399 | A1 | 8/2008 | Chen et al. |
| 2008/0296479 | A1 | 12/2008 | Anderson et al. |
| 2008/0296518 | A1 | 12/2008 | Xu et al. |
| 2008/0317982 | A1 | 12/2008 | Hecht et al. |
| 2009/0085426 | A1 | 4/2009 | Davis et al. |
| 2009/0086923 | A1 | 4/2009 | Davis et al. |
| 2009/0213914 | A1 | 8/2009 | Dong et al. |
| 2009/0243028 | A1 | 10/2009 | Dong et al. |
| 2010/0096595 | A1 | 4/2010 | Prud'Homme et al. |
| 2010/0098216 | A1 | 4/2010 | Dobson |
| 2010/0126660 | A1 | 5/2010 | O'Hara |
| 2010/0140497 | A1 | 6/2010 | Damiano, Jr. et al. |
| 2010/0239828 | A1 | 9/2010 | Cornaby et al. |
| 2010/0243895 | A1 | 9/2010 | Xu et al. |
| 2010/0248343 | A1 | 9/2010 | Aten et al. |
| 2010/0285271 | A1 | 11/2010 | Davis et al. |
| 2010/0323419 | A1 | 12/2010 | Aten et al. |
| 2011/0017921 | A1 | 1/2011 | Jiang et al. |

FOREIGN PATENT DOCUMENTS

| | | |
|---|---|---|
| DE | 19818057 | 11/1999 |
| EP | 0297808 | 1/1989 |
| EP | 0330456 | 8/1989 |
| EP | 0400655 | 5/1990 |
| EP | 0676772 | 3/1995 |
| GB | 1252290 | 11/1971 |
| JP | 57 082954 | 8/1982 |
| JP | 3170673 | 7/1991 |
| JP | 4171700 | 6/1992 |
| JP | 05066300 | 3/1993 |
| JP | 5066300 | 3/1993 |
| JP | 5135722 | 6/1993 |
| JP | 06119893 | 7/1994 |
| JP | 6289145 | 10/1994 |
| JP | 6343478 | 12/1994 |
| JP | 8315783 | 11/1996 |
| JP | 08315783 | 11/1996 |
| JP | 2003/007237 | 1/2003 |
| JP | 2003/088383 | 3/2003 |
| JP | 2003510236 | 3/2003 |
| JP | 2003211396 | 7/2003 |
| JP | 2006297549 | 11/2006 |
| KR | 1020050107094 | 11/2005 |
| WO | WO 99/65821 | 12/1999 |
| WO | WO 00/09443 | 2/2000 |
| WO | WO 00/17102 | 3/2000 |
| WO | WO 03/076951 | 9/2003 |
| WO | WO2008/052002 | 5/2008 |
| WO | WO 2008/052002 | 5/2008 |
| WO | WO 2009/009610 | 1/2009 |
| WO | WO 2009/045915 | 4/2009 |
| WO | WO 2009/085351 | 7/2009 |
| WO | WO 2010/107600 | 9/2010 |

OTHER PUBLICATIONS

Chen, Xiaohua et al., "Carbon-nanotube metal-matrix composites prepared by electroless plating," Composites Science and Technology, 2000, pp. 301-306, vol. 60.

Coleman, et al.; "Mechanical Reinforcement of Polymers Using Carbon Nanotubes"; Adv. Mater. 2006, 18, 689-706.

Coleman, et al.; "Small but strong: A review of the mechanical properties of carbon nanotube-polymer composites"; Carbon 44 (2006) 1624-1652.

Flahaut, E. et al, "Carbon Nanotube-metal-oxide nanocomposites; microstructure, electrical conductivity and mechanical properties," Acta mater., 2000, pp. 3803-3812.Vo. 48.

Gevin et al., "IDeF-X V1.0: performances of a new CMOS multi channel analogue readout ASIC for Cd(Zn)Te detectors", IDDD, Oct. 2005, 433-437, vol. 1.

Grybos et al., "Measurements of matching and high count rate performance of mulitchannel ASIC for digital x-ray imaging systems", IEEE, Aug. 2007, 1207-1215, vol. 54, Issue 4.

(56) References Cited

OTHER PUBLICATIONS

Grybos et al., "Pole-Zero cancellation circuit with pulse pile-up tracking system for low noise charge-sensitive amplifiers", Feb. 2008, 583-590, vol. 55, Issue 1.
http://www.orau.org/ptp/collectio/xraytubescollidge/MachlettCW250T.htm, 1999, 2 pages.
Hu, et al.; "Carbon Nanotube Thin Films: Fabrication, Properties, and Applications"; 2010 American Chemical Society Jul. 22, 2010.
Hutchison, "Vertically aligned carbon nanotubes as a framework for microfabrication of high aspect ration mems," 2008, pp. 1-50.
Jiang, Linquin et al., "Carbon nanotubes-metal nitride composites; a new class of nanocomposites with enhanced electrical properties," J. Mater. Chem., 2005, pp. 260-266, vol. 15.
Li, Jun et al., "Bottom-up approach for carbon nanotube interconnects," Applied Physics Letters, Apr. 14, 2003, pp. 2491-2493, vol. 82 No. 15.
Ma. R.Z., et al., "Processing and properties of carbon nanotubes-nano-SIC ceramic", Journal of Materials Science 1998, pp. 5243-5246, vol. 33.
Micro X-ray Tube Operation Manual, X-ray and Specialty Instruments Inc., 1996, 5 pages.
Moore, A. W., S. L. Strong, and G. L. Doll, "Properties and characterization of codeposited boron nitride and carbon materials," J. Appl. Phys. 65, 5109 (1989).
Najafi, et al.; "Radiation resistant polymer-carbon nanotube nanocomposite thin films"; Department of Materials Science and Engineering . . . Nov. 21, 2004.
Nakajima et al; Trial Use of Carbon-Fiber-Reinforced Plastic as a Non-Bragg Window Material of X-Ray Transmission; Rev. Sci. Instrum.; Jul. 1989; pp. 2432-2435; vol. 60, No. 7.
Nakamura, K., "Preparation and properties of amorphous boron nitride films by molecular flow chemical vapor deposition," J. Electrochem. Soc. 132, 1757 (1985).
Panayiotatos, et al., "Mechanical performance and growth characteristics of boron nitride films with respect to their optical, compositional properties and density," Surface and Coatings Technology, 151-152 (2002) 155-159.
Peigney, et al., "Carbon nanotubes in novel ceramic matrix nanocomposites," Ceramics International, 2000, pp. 677-683, vol. 26.
Perkins, F. K., R. A. Rosenberg, and L. Sunwoo, "Synchrotronradiation deposition of boron and boron carbide films from boranes and carboranes: decaborane," J. Appl. Phys. 69,4103 (1991).
Rankov et al., "A novel correlated double sampling poly-Si circuit for readout systems in large area x-ray sensors", IEEE, May 2005, 728-731, vol. 1.
Roca i Cabarrocas, P., S. Kumar, and B. Drevillon, "In situ study of the thermal decomposition of B.sub.2 H.sub.6 by combining spectroscopic ellipsometry and Kelvin probe measurements," J. Appl. Phys. 66, 3286 (1989).
Satishkumar B.C., et al. "Synthesis of metal oxide nanorods using carbon nanotubes as templates," Journal of Materials Chemistry, 2000, pp. 2115-2119, vol. 10.
Scholze et al., "Detection efficiency of energy-dispersive detectors with low-energy windows" X-Ray Spectrometry, X-Ray Spectrom, 2005: 34: 473-476.
Sheather, "The support of thin windows for x-ray proportional counters," Journal Phys,E., Apr. 1973, pp. 319-322, vol. 6, No. 4.
Shirai, K., S.-I. Gonda, and S. Gonda, "Characterization of hydrogenated amorphous boron films prepared by electron cyclotron resonance plasma chemical vapor deposition method," J. Appl. Phys. 67, 6286 (1990).
Tamura, et al "Developmenmt of ASICs for CdTe Pixel and Line Sensors", IEEE Transactions on Nuclear Science, vol. 52, No, 5, Oct. 2005.
Tien-Hui Lin et al., "An investigation on the films used as the windows of ultra-soft X-ray counters." Acta Physica Sinica, vol. 27, No. 3, pp. 276-283, May 1978, abstract only.
U.S. Appl. No. 12/640,154, filed Dec. 17, 2009, Krzysztof Kozaczek.
U.S. Appl. No. 12/726,120, filed Mar. 17, 2010, Michael Lines.
U.S. Appl. No. 12/783,707, filed May 20, 2010, Steven D. Liddiard.
U.S. Appl. No. 12/899,750, filed Oct. 7, 2010, Steven Liddiard.
U.S. Appl. No. 13/018,667, filed Feb. 1, 2011, Robert C. Davis.
U.S. Appl. No. 13/018,667, filed Feb. 1, 2011, Lei Pei.
U.S. Appl. No. 13/307,579, filed Nov. 30, 2011, Dongbing Wang.
Vajtai et al.; Building Carbon Nanotubes and Their Smart Architectures; Smart Mater. Struct.; 2002; vol. 11; pp. 691-698.
Vandenbulcke, L. G., "Theoretical and experimental studies on the chemical vapor deposition of boron carbide," Indust. Eng. Chem. Prod. Res. Dev. 24, 568 (1985).
Viitanen Veli-Pekka et al., Comparison of Ultrathin X-Ray Window Designs, presented at the Soft X-rays in the 21st Century Conference held in Provo, Utah Feb. 10-13, 1993, pp. 182-190.
Wagner et al, "Effects of Scatter in Dual-Energy Imaging: An Alternative Analysis"; IEEE; Sep. 1989, vol. 8. No. 3.
Wang, et al.; "Highly oriented carbon nanotube papers made of aligned carbon nanotubes"; Tsinghua-Foxconn Nanotechnology Research Center and Department of Physics; Published Jan. 31, 2008.
Winter, J., H. G. Esser, and H. Reimer, "Diborane-free boronization," Fusion Technol. 20, 225 (1991).
Wu, et al.; "Mechanical properties and thermo-gravimetric analysis of PBO thin films"; Advanced Materials Laboratory, Institute of Electro-Optical Engineering; Apr. 30, 2006.
www.moxtek,com, Moxtek, Sealed Proportional Counter X-Ray Windows, Oct. 2007, 3 pages.
www.moxtek.com, Moxtek, AP3 Windows, Ultra-thin Polymer X-Ray Windows, Sep. 2006, 2 pages.
www.moxtek.com, Moxtek, DuraBeryllium X-Ray Windows, May 2007, 2 pages.
www.moxtek.com, Moxtek, ProLine Series 10 Windows, Ultra-thin Polymer X-Ray Windows, Sep. 2006, 2 pages.
Xie, et al.; "Dispersion and alignment of carbon nanotubes in polymer matrix: A review"; Center for Advanced Materials Technology; Apr. 20, 2005.
Yan, Xing-Bin, et al., Fabrications of Three-Dimensional ZnO-Carbon Nanotube (CNT) Hybrids Using Self-Assembled CNT Micropatterns as Framework, 2007. pp. 17254-17259, vol. III.
Zhang, et al.; "Superaligned Carbon Nanotube Grid for High Resolution Transmission Electron Microscopy of Nanomaterials"; 2008 American Chemical Society.
U.S. Appl. No. 12/890,325, filed Sep. 24, 2010, Dongbing Wang; office action dated Sep. 7, 2012.
PCT Application No. PCT/US2011/044168; filed Mar. 28, 2012; Kang Hyun Il; report mailed Mar. 28, 2012.
U.S. Appl. No. 12/899,750, filed Oct. 7, 2010, Steven Liddiard; notice of allowance dated Jun. 4, 2013.
U.S. Appl. No. 12/890,325, filed Sep. 24, 2010, Dongbing Wang; notice of allowance dated Jul. 16, 2013.

* cited by examiner

COLD ELECTRON NUMBER AMPLIFIER

CLAIM OF PRIORITY

Priority is claimed to U.S. Provisional Patent Application Ser. No. 61/443,822, filed Feb. 17, 2011; which is hereby incorporated herein by reference in its entirety.

BACKGROUND

1. Field of the Invention

The present invention relates generally to x-ray tubes and cold electron number amplifiers.

2. Related Art

Many devices require generation of electrons. For example an x-ray tube can include a cathode attached to one end of an evacuated tube and an anode attached at an opposing end. The cathode can include an electron emitter, such as a filament. The filament can be heated, such as by a laser or an alternating current flowing through the filament. Due to the heat of the filament (1500-2000° C. for example) and a very large voltage differential between the filament and the anode (10 kV-100 kV for example) electrons can leave the filament and accelerate towards the anode. The anode can include a material that will emit x-rays in response to impinging electrons. Other examples of devices that require generation of electrons are cathode-ray tubes, electron microscopes, gas electron tubes or gas discharge tubes, and travelling wave tubes.

Electrons in the above devices can be generated by electron emitters, such as a filament. Due to the high required electron emitter temperature for the desired rate of electron emission, the electron emitter can fail at an undesirably low life. For example, in x-ray tubes, filament failure can be one of the most common failures and limiting factors in extending x-ray tube life. It would be desirable to be able to operate electron emitters at a lower temperature than is presently used while maintaining the same electron generation rate.

SUMMARY

It has been recognized that it would be advantageous to be able to operate electron emitters at a lower temperature than is presently used while maintaining the same electron generation rate. The present invention is directed to a cold electron number amplifier that satisfies the need for producing the same rate of electrons while allowing the electron emitter to operate at a lower temperature.

The apparatus comprises an evacuated enclosure, a first electron emitter attached to the evacuated enclosure and configured to emit electrons within the evacuated enclosure, and an electrically conductive second electron emitter, also attached to the evacuated enclosure. The electrically conductive second electron emitter is configured to have a voltage greater than a voltage of the first electron emitter and is positioned to receive impinging electrons from the first electron emitter. Electrons from the first electron emitter impart energy to electrons in the second electron emitter and cause the second electron emitter to emit more electrons.

Due to additional electrons produced by the second electron emitter, the same rate of total electrons may be produced with less electrons produced by the first electron emitter. Due to lower required electron generation rate of the first electron emitter, it can be operated at a lower temperature, which can result in longer first electron emitter life.

DEFINITIONS

Figure 1:
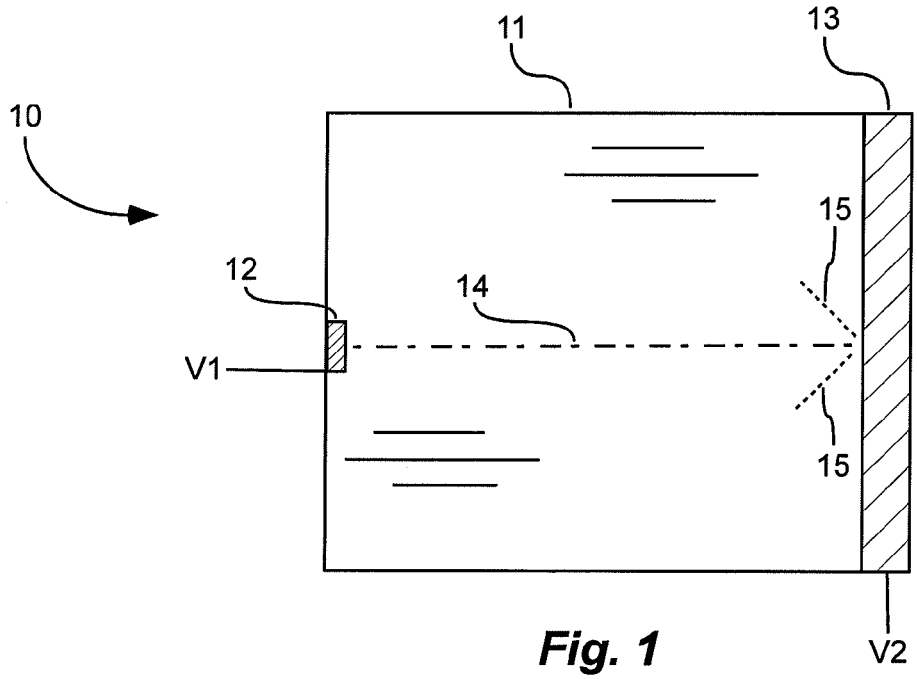
FIG. 1 is a schematic cross-sectional side view of a cold electron number amplifier in accordance with an embodiment of the present invention.

As used herein, the term "about" is used to provide flexibility to a numerical range endpoint by providing that a given value may be "a little above" or "a little below" the endpoint.

As used herein, the term "evacuated enclosure" means a sealed enclosure that has an internal pressure less than atmospheric pressure. The actual internal pressure will depend on the application. For example, the internal pressure may be less than 0.1 atm, less than 0.001 atm, less than $0^{-8}$ atm, less than $10^{-6}$ atm, or less than $10^{-8}$ atm.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

DETAILED DESCRIPTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1, a cold electron number amplifier 10 is shown comprising an evacuated enclosure 11, a first electron emitter 12 attached to the evacuated enclosure 11, and an electrically conductive second electron emitter 13 also attached to the evacuated enclosure. The first electron emitter 12 is configured to emit electrons 14 within the evacuated enclosure 11.

The second electron emitter 13 is configured to have a voltage V2 greater than a voltage V1 of the first electron emitter 12 (V2>V1). In the various embodiments described herein, a voltage differential between the first electron emitter 12 and the second electron emitter 13 can be sufficiently high so that electrons in the second electron emitter 13 will have enough energy to exit the second electron emitter 13. For example, the voltage V2 of the second electron emitter 13 can be greater than a voltage V1 of the first electron emitter by more than a work function of the second electron emitter 13.

The second electron emitter 13 is positioned to receive impinging electrons 14 from the first electron emitter 12. Electrons 14 from the first electron emitter 12 impart energy to electrons in the second electron emitter 13 and cause the second electron emitter 13 to emit more electrons 15. A larger voltage differential (V2-V1) between the first electron emitter 12 and the second electron emitter 13, can result in an increased rate of electron generation at the second electron emitter. Such large voltage differential (V2-V1) can be in one embodiment, 10 times the work function of the second electron emitter 13, in another embodiment 100 times the work function of the second electron emitter 13, and in another embodiment 1000 times the work function of the second electron emitter 13.

Due to additional electrons produced by the second electron emitter, the same rate of total electrons may be produced with less electrons produced by the first electron emitter. Due to lower required electron generation rate of the first electron emitter, it can be operated at a lower temperature, which can result in longer first electron emitter life.

In the various embodiments described herein, many more electrons 15 can be emitted from the second electron emitter 13 than are emitted from the first electron emitter 12. In one embodiment, at least ten times more electrons 15 are emitted from the second electron emitter 13 than are emitted from the first electron emitter 12. In another embodiment, at least 50 times more electrons 15 are emitted from the second electron emitter 13 than are emitted from the first electron emitter 12. In another embodiment, at least 500 times more electrons 15 are emitted from the second electron emitter 13 than are emitted from the first electron emitter 12.

The above described cold electron number amplifier 10 can be used in many devices that require generation of electrons, such as x-ray tubes, cathode-ray tubes. electron microscopes, gas electron tubes or gas discharge tubes, and travelling wave tubes. Such devices can be operated at very large voltage differentials. For example, a voltage differential between the first electron emitter 12 and the electrode 23 can be at least 9 kilovolts. A configuration that may be used in such devices is shown in FIG. 2, wherein cold electron number amplifier 20 includes an electrode 23 attached to the evacuated enclosure, configured to have a voltage V3 greater than the voltage V2 of the second electron emitter 13 and positioned to cause electrons 15 from the second electron emitter 13 to accelerate within the evacuated enclosure 11 towards the electrode 23.

Figure 2:
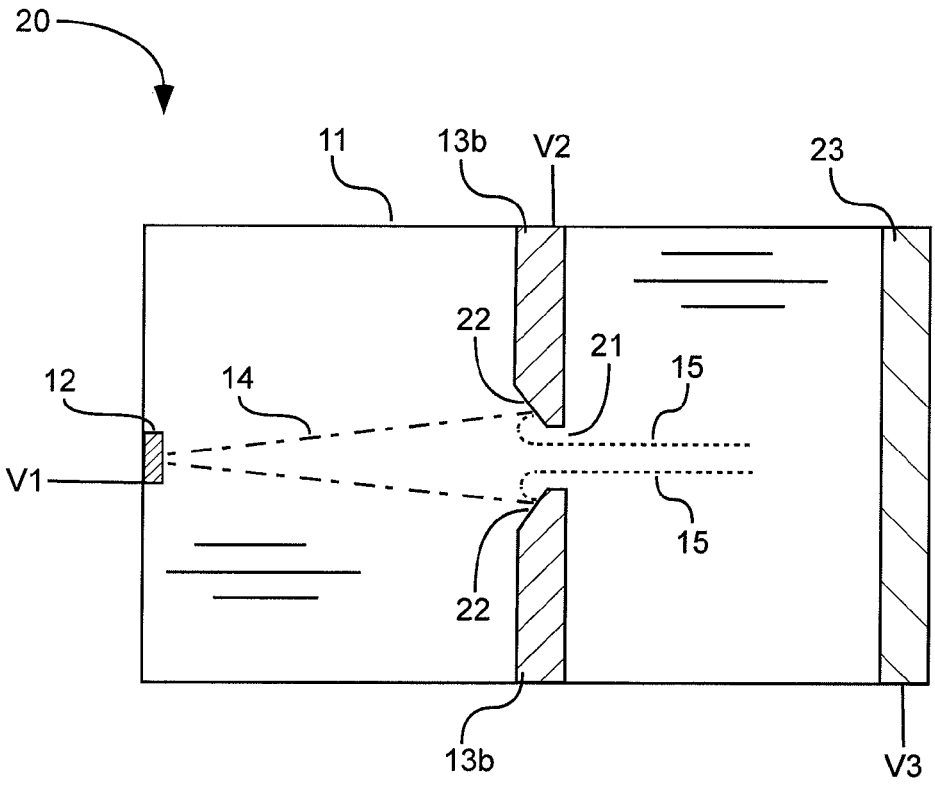
FIG. 2 is a schematic cross-sectional side view of a cold electron number amplifier in which the second electron emitter is disposed between the first electron emitter and the electrode and the second electron emitter has a hole allowing electrons from the second electron emitter to be propelled therethrough towards the electrode, in accordance with an embodiment of the present invention.

Also shown in FIG. 2, the second electron emitter 13 can be disposed between the first electron emitter 12 and the electrode 23 and the second electron emitter 12 can have a hole 21 allowing electrons from the second electron emitter 13 to be propelled therethrough towards the electrode 23.

Also shown in FIG. 2, the second electron emitter 13 can have a slanted surface 22 facing the first electron emitter 12 to provide greater surface area for electrons 14 from the first electron emitter 12 to impinge upon. Having greater surface area for electrons to impinge upon can result in increased emission of electrons 15 from the second electron emitter 13.

Figure 3:
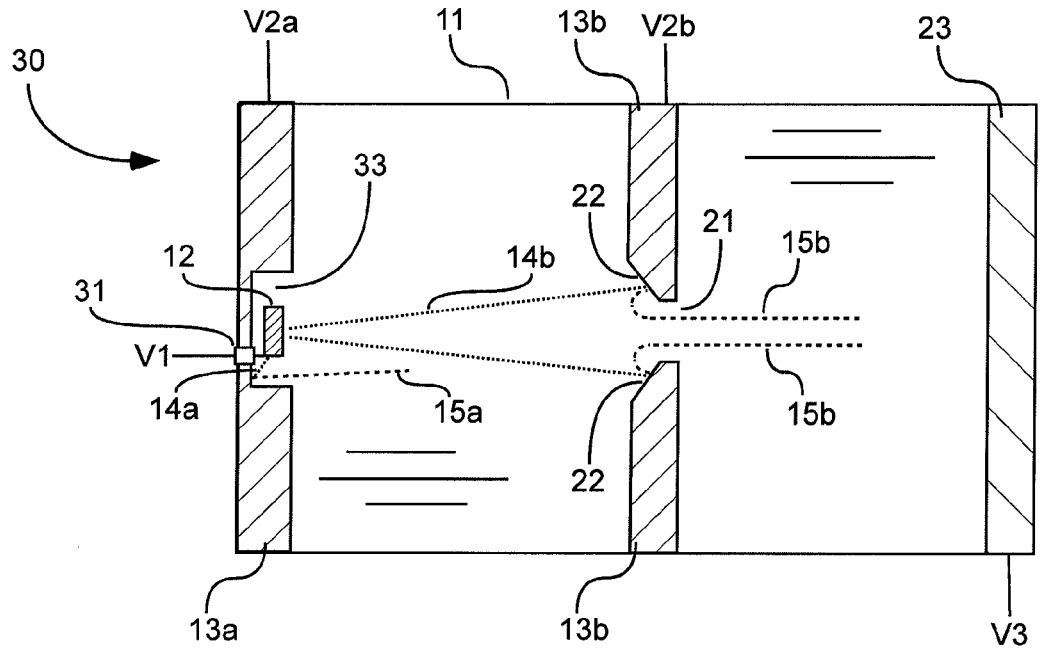
FIG. 3 is a schematic cross-sectional side view of a cold electron number amplifier wherein the second electron emitter comprises at least two second electron emitters including one disposed between the first electron emitter and the electrode and containing a hole and another disposed on an opposite side of the first electron emitter from the electrode, in accordance with an embodiment of the present invention.

As shown in FIG. 3, the first electron emitter 12 can be disposed between the second electron emitter 13*a* and the electrode 23. This configuration may be preferred for manufacturability. Also, in this design, electrons 14*a* emitted from the first electron emitter 12 in a direction not directly towards the electrode 23 can impinge upon the second electron emitter 13*a* and result in more electrons 15*a* emitted from the second electron emitter 13*a*. The first electron emitter 12 can be disposed in a cavity 33 in the second electron emitter 13*a*.

In one embodiment of the present invention, the second electron emitter 13*b* can be disposed between the first electron emitter 12 and the electrode 23 and the second electron emitter 12 can have a hole 21 allowing electrons from the second electron emitter 13*b* to be propelled therethrough towards the electrode 23. In another embodiment of the present invention, the first electron emitter 12 can be disposed between the second electron emitter 13*a* and the electrode 23. As shown in FIG. 3, in another embodiment of the present invention, multiple second electron emitters 13*a-b* may be used.

For example, the cold electron number amplifier 30 of FIG. 3 includes one second electron emitter 13*b* disposed between the first electron emitter 12 and the electrode 23 and another of the second electron emitters 13*a* disposed on an opposite side of the first electron emitter 12 from the electrode 23. This design can result in more electrons from the first electron emitter 12 impinging upon a second electron emitter 13. Not shown in FIG. 3, the second electron emitters 13*a-b* could connect and surround the first electron emitter 12 with the exception of an insulated channel 31 for providing voltage to the first electron emitter 12, means of attaching the first electron emitter 12, and a hole 21 for allowing electrons 15*b* to move towards the anode.

Voltages V2*a-b* attached to the second electron emitters 13*a-b* can be the same (V2*a*=V2*b*) or different from (V2*a*≠V2*b*) each other. Whether the two voltages V2*a* and V2*b* are the same or different is dependent upon the desired electric field produced between the first electron emitter 12 and the second electron emitters 13*a-b* and the difficulty of providing an extra voltage.

Figure 4:
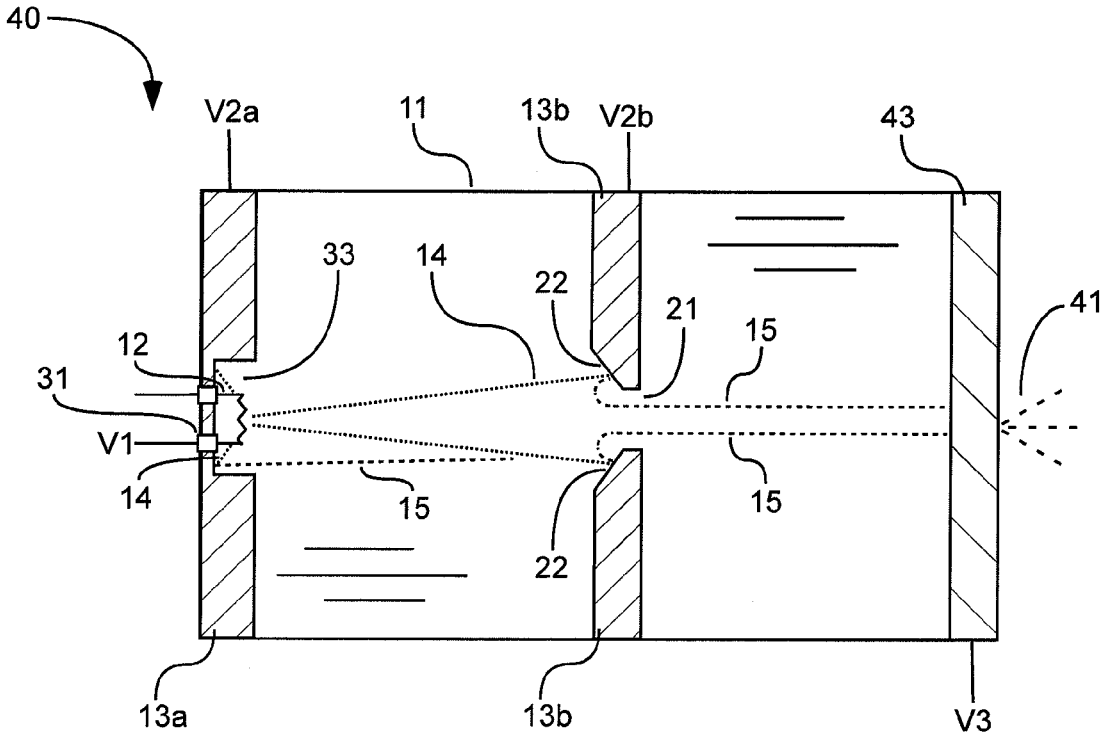
FIG. 4 is a schematic cross-sectional side view of an x-ray tube with second electron emitters in accordance with an embodiment of the present invention.

Shown in FIG. 4 is an x-ray tube 40 comprising an evacuated enclosure 11, a first electron emitter 12 can be attached to the evacuated enclosure 11 and configured to emit electrons 14 within the evacuated enclosure 11 and an anode 43 can be attached to the evacuated enclosure 11 and configured to emit x-rays 41 in response to impinging electrons 15. The x-ray tube 40 also includes at least one electrically conductive second electron emitter 13. The second electron emitter(s) can include a second electron emitter 13*b* disposed between the first electron emitter 12 and the anode 43 with a hole 21 for allowing passage of electrons 15 and/or a second electron emitter 13*a* disposed on an opposite side of the first electron emitter 12 from the anode 43.

Voltage(s) V2*a-b* of the second electron emitter(s) 13*a-b* can be greater than a voltage V1 of the first electron emitter 13*a*. A voltage V3 of the anode 43 can be greater than a voltage V2*a-b* of the second electron emitter(s) 13*a-b*. A voltage differential between the first electron emitter 12 and the anode 43 can be at least 9 kilovolts (V3-V1>9 kV). A voltage differential between the first electron emitter 12 and the second electron emitter(s) 13*a-b* can be greater than a work function of the second electron emitter(s) 13*a-b*. For example, a voltage of the first electron emitter 12 can be less than about −20 kilovolts (kV), a voltage of the anode can be about 0 volts, and voltage(s) of the second electron emitter(s) can be between about −20 kV and 0 volts.

Impinging electrons 14 from the first electron emitter 12 on the second electron emitter(s) 13*a-b* impart energy to electrons in the second electron emitter(s) 13*a-b*, thus causing additional electrons 15 to be emitted from the second electron emitter(s) 13*a-b*. Electrons 15 from the second electron emitter(s) 13*a-b* can accelerate towards and impinge upon the anode 43. Electrons 15 impinging upon the anode 43 can cause the anode to emit x-rays 41.

A method of producing x-rays 41 in an x-ray tube 40 can include:

1. providing a voltage differential between a first electron emitter 12 and an anode 43, both within the x-ray tube 40, of at least 1 kilovolt;
2. providing an electrically conductive second electron emitter 13 with a voltage that is between a voltage of the first electron emitter 12 and a voltage of the anode 43;
3. providing a voltage differential between the first electron emitter 12 and the second electron emitter 13 that is greater than a work function of the second electron emitter 13;
4. emitting electrons 14 from the first electron emitter 12 and propelling the electrons 14 from the first electron emitter 12 to impinge upon the second electron emitter 13;
5. multiplying a total number of electrons by emitting at least 10 electrons 15 from the second electron emitter 13 for every electron 14 impinging upon the second electron emitter 13;
6. propelling the electrons 15 from the second electron emitter 13 towards the anode 43 and impinging upon the anode 43; and
7. emitting x-rays 41 from the anode 43 as a result of the electrons 15 which impinged upon the anode 43.

Figure 5:
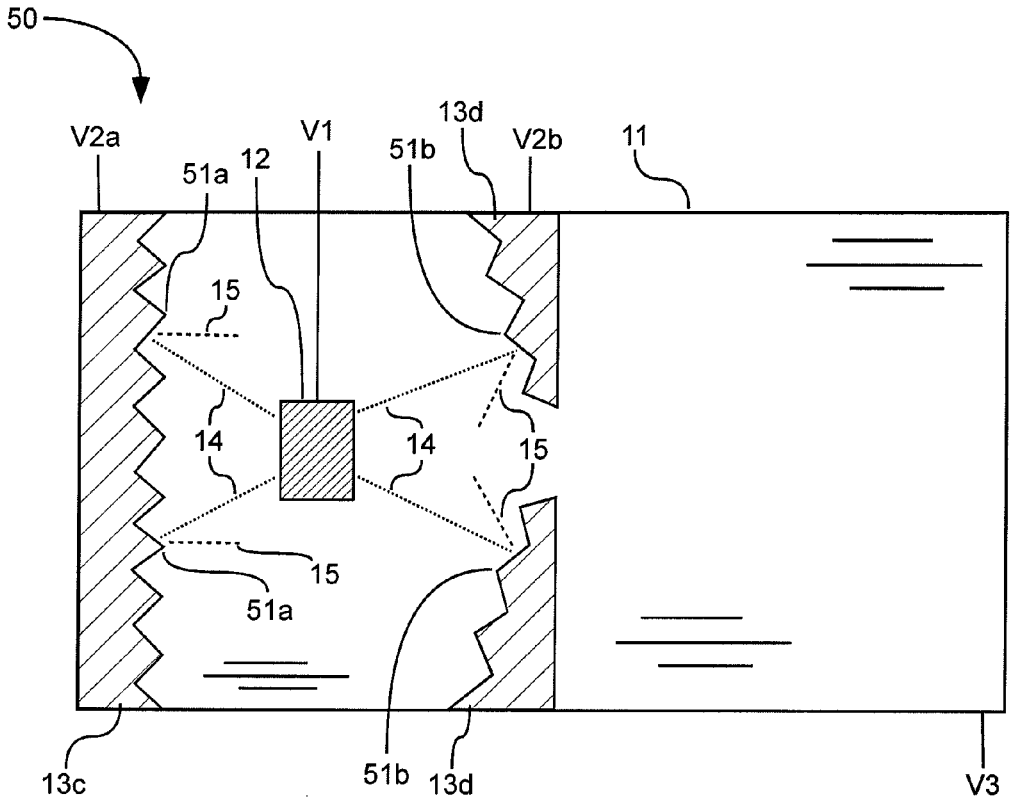
FIG. 5 is a schematic cross-sectional side view of a cold electron number amplifier wherein the second electron emitter has protrusions facing the first electron emitter to provide greater surface area for electrons from the first electron emitter to impinge upon the protrusions of the second electron emitter, in accordance with an embodiment of the present invention.

In one embodiment, shown in FIG. 5, second electron emitters 13*c-d* can have protrusions 51*a-b* facing the first electron emitter 12 to provide greater surface area for electrons 14 from the first electron emitter 12 to impinge upon. Having greater surface area for electrons 14 to impinge upon can result in increased emission of electrons 15 from the second electron emitter 13. The protrusions 51*a-b* in this embodiment may be used in various embodiments described herein.

Figure 6:
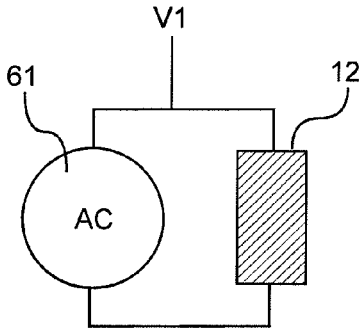
FIG. 6 is a schematic cross-sectional side view of a first electron emitter which is heated by alternating current, in accordance with an embodiment of the present invention.
Figure 7:
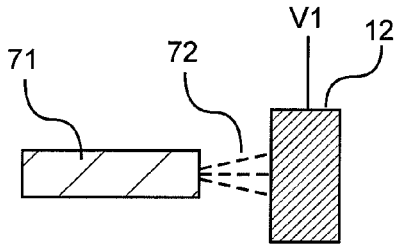
FIG. 7 is a schematic cross-sectional side view of a first electron emitter which is heated by photons, in accordance with an embodiment of the present invention.

As shown in FIG. 6, a first electron emitter 12 can be heated by alternating current passing through first electron emitter 12. The alternating current can be supplied by an alternating current source 61. The first electron emitter 12 can be a filament. As shown in FIG. 7, a first electron emitter 12 can be heated by electromagnetic energy or photons 72 from a supply 71, such as a laser.

The second electron emitter 13 can be electrically conductive and can be is metallic, such as tungsten for example.

For the various embodiments described herein, the second electron emitter 13 can be manufactured by machining. The second electron emitter 13 can be attached to the evacuated enclosure 11 by an adhesive or by welding.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A method of producing x-rays in an x-ray tube, the method comprising:

a) providing a voltage differential between a first electron emitter and an anode, both within the x-ray tube, of at least 1 kilovolt;

b) providing an electrically conductive second electron emitter with a voltage that is between a voltage of the first electron emitter and a voltage of the anode;

c) providing a voltage differential between the first electron emitter and the second electron emitter that is greater than a work function of the second electron emitter;

d) emitting electrons from the first electron emitter and propelling the electrons from the first electron emitter to impinge upon the second electron emitter;

e) multiplying a total number of electrons by emitting at least 10 electrons from the second electron emitter for every electron impinging upon the second electron emitter;

f) propelling the electrons from the second electron emitter towards the anode and impinging upon the anode; and g) emitting x-rays from the anode as a result of the electrons which impinged upon the anode.

2. The method of claim 1, wherein at least 500 electrons are emitted from the second electron emitter for every electron impinging upon the second electron emitter.

3. An x-ray tube comprising:

a) an evacuated enclosure having an internal pressure of less than $10^{-6}$ atm;

b) a first electron emitter attached to the evacuated enclosure and configured to emit electrons;

c) an anode attached to the evacuated enclosure and configured to emit x-rays in response to impinging electrons;

e) an electrically conductive second electron emitter disposed within the evacuated enclosure between the first electron emitter and the anode;

e) a voltage of the second electron emitter is greater than a voltage of the first electron emitter;

f) a voltage of the anode is greater than a voltage of the second electron emitter;

g) a voltage differential between the first electron emitter and the anode of at least 9 kilovolts;

h) a voltage differential between the first electron emitter and the second electron emitter that is greater than a work function of the second electron emitter;

i) the second electron emitter having a hole between the first electron emitter and the anode;

j) impinging electrons on the second electron emitter, from the first electron emitter, impart energy to electrons in the second electron emitter, thus causing additional electrons to be emitted from the second electron emitter;

k) at least ten times more electrons are emitted from the second electron emitter than are emitted from the first electron emitter;

l) electrons from the second electron emitter accelerate towards and impinge upon the anode; and m) electrons impinging upon the anode cause the anode to emit x-rays.

4. The x-ray tube of claim 3 wherein the voltage differential between the first electron emitter and the second electron emitter is greater than 100 times a work function of the second electron emitter.

* * * * *